United States Patent [19]

Ward

[11] 4,205,378

[45] May 27, 1980

[54] INTERNAL COMBUSTION ENGINE FUEL CONTROL SYSTEM

[75] Inventor: Peter J. Ward, Hampton in Arden, England

[73] Assignee: Lucas Industries Limited, Birmingham, England

[21] Appl. No.: 914,454

[22] Filed: Jun. 12, 1978

[30] Foreign Application Priority Data

Jun. 23, 1977 [GB] United Kingdom ..... 26295/77

[51] Int. Cl.[2] ..... F02D 35/00; F02B 75/10

[52] U.S. Cl. ..... 364/431; 60/276; 60/285; 123/32 EE; 123/119 EC

[58] Field of Search ..... 369/424, 431, 442; 123/32 EE, 119 EC; 60/276, 285; 328/146-151; 307/359

[56] References Cited

U.S. PATENT DOCUMENTS

| | | | |
|---|---|---|---|
| 3,569,739 | 3/1971 | Stolman | 328/146 |
| 3,816,760 | 6/1974 | Slawson et al. | 307/359 |
| 3,866,063 | 2/1975 | Long | 328/150 |
| 4,112,893 | 9/1978 | Anzai | 123/32 EE |
| 4,121,554 | 10/1978 | Sueishi et al. | 123/32 EE |
| 4,122,811 | 10/1978 | Bowler et al. | 364/442 |
| 4,132,193 | 1/1979 | Takase et al. | 123/32 EE |
| 4,132,200 | 1/1979 | Asano et al. | 123/119 EC |
| 4,153,023 | 5/1979 | Asano et al. | 123/119 EC |

*Primary Examiner*—Felix D. Gruber

*Attorney, Agent, or Firm*—Ladas, Parry, Von Gehr, Goldsmith & Deschamps

[57] ABSTRACT

An internal combustion engine fuel ignition system has feedback from an exhaust gas composition transducer which operates effectively only at normal exhaust temperatures, the transducer having a very high impedance at low temperatures. The feedback circuit includes a comparator stage and an integrator stage integrating the output of the comparator stage which compares the transducer output with a reference voltage. A feedback resistor is connected from the integrator stage output to the comparator stage input, so that, at low temperature the integrator stage output stabilises at a predetermined level. Only when the transducer warms up so that its impedance becomes significantly less than that of the feedback resistor does the exhaust feedback control loop become effective.

7 Claims, 3 Drawing Figures

INTERNAL COMBUSTION ENGINE FUEL CONTROL SYSTEM

FIELD OF THE INVENTION

This invention relates to internal combustion engine fuel control systems of the general type in which an exhaust gas composition sensing device is used to generate a signal which is fed back into the fuel control circuit to provide closed loop control.

DESCRIPTION OF THE PRIOR ART

One known system makes use of an exhaust gas composition sensing device which has a very high output impedance at low temperature. Once the device has been warmed by the exhaust gas to an adequate operating temperature it can provide a very accurate indication of the existence of a satisfactory exhaust gas composition, but at low temperatures the high output impedance of the device makes the use of a closed loop control unsatisfactory. In the known system complex electronic arrangements are employed for measuring the temperature or output impedance of the device and inhibiting the closed loop control until the temperature becomes adequate.

SUMMARY OF THE INVENTION

It is an object of the present invention to provide a control system of the general type referred to, in which a simple and effective arrangement is employed for overcoming the problem of the sensing devices high output impedance at low temperature.

A control system in accordance with the invention comprises an exhaust gas composition sensing device having a high output impedance at low temperature, but producing when at operating temperature, a voltage signal related to the exhaust gas composition and a fuel control circuit to which said sensing device is connected so that variations in the voltage signal therefrom vary the fuel flow to the engine so as to cause the voltage signal to approach a desired level, said fuel control circuit including an input stage connected to the sensor and to a reference voltage source such that the output of said input stage is dependent on the relative levels of the signal voltage and the reference voltage, an integrator stage connected to the output of the input stage and producing an output which changes relatively slowly as a result of changes in the output of the input stage, the output of the integrator stage determining the rate at which fuel is supplied to the engine and a high impedance negative feedback circuit connecting the output of the integrator stage to an input terminal of the input stage and including a high impedance feedback path of impedance less than that of the sensing device at low temperature and higher than that of the sensing device at operating temperature, said feedback circuit causing the output of the integrator to approach a desired value when the sensing device is at low temperature.

Preferably the input stage is a voltage comparator and the integrator stage is an operational amplifier integrator. In this case the feedback circuit may comprise a resistive potential divider connected between the operational amplifier output and earth and arranged to establish a voltage equal to the reference voltage when the operational amplifier output is at its desired value, said high impedance path being a high impedance resistor connected between said potential divider and an input terminal of the voltage comparator.

With such an arrangement, when the sensing device is cold the negative feedback via the resistor is more significant than any signals which may be generated by the sensing device, so that the output voltage of the operation amplifier integrator settles at said desired value, with the possibility of a small amplitude ripple introduced as a result of any hysteresis in the voltage comparator. When the sensing device warms up to its operating temperature the negative feedback becomes insignificant and does not interfere with the normal operation of the system.

The connection between the comparator output and the integrator input may include a switch device which is controlled so as to be conductive periodically at a frequency dependent on engine speed and for a fixed duration at each operation. In this way the integrator output changes by a fixed amount per engine revolution (rather than per unit time).

In some circumstances it is required to override the closed loop control even when the sensing device is at its normal operating temperature, for example when full engine power is demanded. This can readily be achieved with the control system described above by the simple expedient of utilizing a switch connected across the high impedance resistor. When this switch is closed the negative feedback to the comparator swamps the signal voltage and causes the integrator output to approach its desired value.

BRIEF DESCRIPTION OF THE DRAWINGS

In the accompanying drawings

DESCRIPTION OF THE PREFERRED EMBODIMENTS

Figure 1:
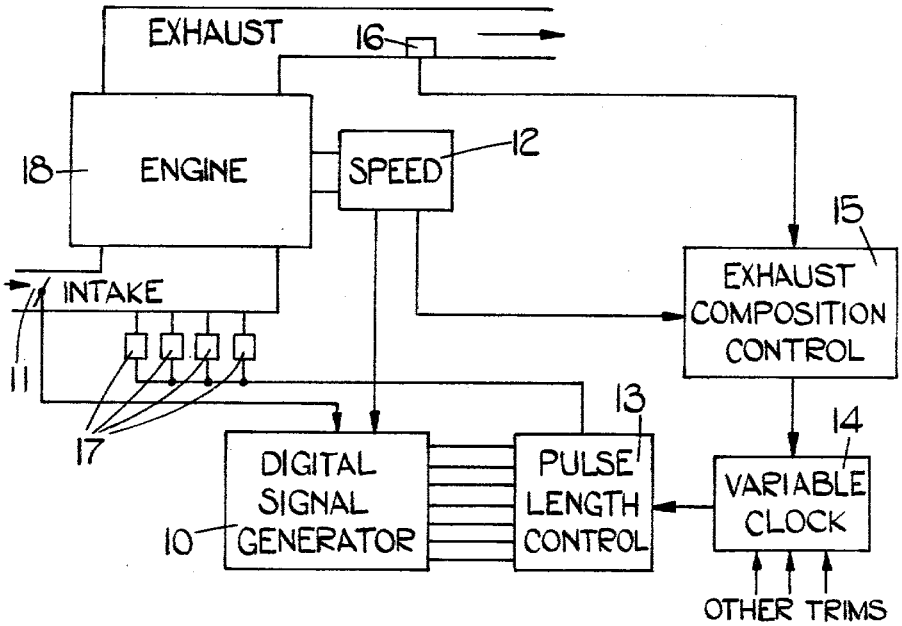
FIG. 1 is a block diagram showing an example of a fuel control system in accordance with the invention.

Referring firstly to FIG. 1 the fuel control system shown comprises a main digital control signal generating unit 10 which receives signals from a throttle angle transducer 11 and an engine speed transducer 12 and produces a multi-bit digital output signal in known manner by utilizing a programmed read only memory as a three dimensional digital function generator. The digital output signal from the generator 10 is applied to a pulse length control 13 where it is converted into a pulse duration in known manner using input pulses from a variable frequency clock 14. Various trims such as engine coolant temperature are applied to the clock 14 but the main controlling parameter is the output of an exhaust composition control circuit 15 which receives control signals from an exhaust composition sensor 16. The pulse length control 13 controls the quantity of fuel supplied to the engine 18 by varying the duration of energising pulses applied to a plurality of solenoid operable fuel injection valves 17.

Figure 2:
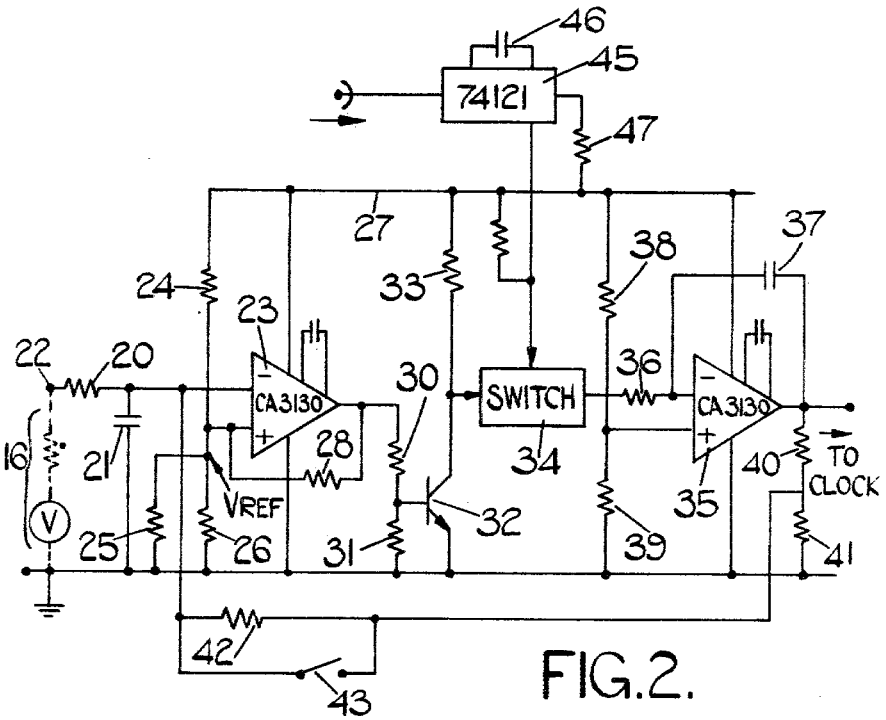
FIG. 2 is the electrical circuit diagram of an exhaust composition control forming a part of the system of FIG. 1.

Turning now to FIG. 2 the exhaust composition control circuit includes an input filter consisting of a resistor 20 and a capacitor 21 connected in series between an input terminal 22 and earth. This filter may have a very short time constant such as 0.1 mS so that it acts only to remove high frequency noise.

The circuit has an input stage comprising a high input impedance operational amplifier 23 connected as a voltage comparator with hysteresis. The junction of the resistor 20 and the capacitor 21 is connected to the inverting input terminal of the amplifier 23, a potential divider chain consisting of three resistors 24, 25, and 26 connected between a supply rail 27 and earth provide an input to the non-inverting input terminal of the amplifier 23. This potential divider chain is arranged to provide a reference voltage $V_{REF}$ in the region of 350 mV at the non-inverting input terminal of the amplifier 23. Positive feedback around the amplifier 23 is provided by a resistor 28 connected between the output terminal of the amplifier 23 and its non-inverting input terminal, the resistor 28 having an ohmic value very much greater than that of the combination of resistors 24, 25, 26 so that the hysteresis it introduces into the comparator is only small.

The output terminal of the amplifier 23 is connected to earth by two resistors 30, 31 in series with their common point connected to the base of an npn transistor 32 having its emitter earthed and its collector connected by a resistor 33 to the rail 27.

The collector of the transistor 32 (which is the output terminal of the input stage) is connected by an f.e.t. switch device 34 to an operational amplifier integrator including an operational amplifier 35, an input resistor 36 connecting the switch device 34 to the inverting input terminal of the operational amplifier and a feedback capacitor 37 connecting the output terminal of the amplifier 35 to its inverting input terminal. The non-inverting input terminal of the amplifier 35 is biased to mid-rail voltage by a potential divider chain consisting of two equal value resistors 38, 39 connected between the rail 27 and earth. The output terminal of the amplifier 35 is connected to a control terminal of the clock 14 and is also connected by two resistors 40, 41 in series to earth. The values of these resistors 40, 41 are so chosen so that when the output terminal of the amplifier 35 is at mid-rail voltage (or some other desired value) the potential at the common point of the resistors 40, 41 is approximately equal to $V_{REF}$- i.e., about 350 mV. The common point of these resistors 40, 41 is connected by a high impedance resistor 42 to the inverting input terminal of the operational amplifier 23.

The switch device 34 is controlled by an integrated circuit monostable multivibrator 45 provided with a timing capacitor 46 and a timing resistor 47 to provide fixed duration output pulse each time the speed transducer (which may include a simple mechanical contact breaker or an electromagnetic device) produces a pulse. The switch device 34 is conductive for a fixed total time in each engine shaft revolution so that the integrator 35, 36, 37 integrates with respect to engine shaft displacement rather than with respect to time.

The sensing device 16 may typically be an oxygen sensor of a type supplied by Lucas Electrical Limited under their designation 2LS. Such a sensing device may be regarded as the combination of a voltage source dependent both on oxygen content and on temperature with an output resistor dependent on temperature. Both the source voltage and the resistance characteristics vary with age and use so that exact matching of the device to a control circuit for linear operation is very difficult. It is, however, found that over a wide range of "normal" operation temperatures a d.c. output of less than 350 mV into a high impedance load indicates that oxygen is present in the gas surrounding the device, whereas an output more than 350 mV indicates that no oxygen is present. Clearly, therefore, in an exhaust gas composition control application a "low" output voltage indicates that too little fuel is being supplied and a "high" output voltage indicates that too much fuel is being supplied.

In these "normal" operating circumstances the output resistance of the device 16 is insignificant when compared with the resistance of the feedback resistor 42. Thus when the device 16 output exceeds 350 mV the output of the amplifier 35 decreases linearly with engine shaft angular displacement. This causes the clock frequency to decrease, thereby reducing the output pulse duration of circuit 13 and reducing the rate of fuel flow to the engine. Similarly when the device 16 output is less than 350 mV the fuel flow increases.

At low temperature, for example when the engine has just been started, the voltage and impedance characteristics of the device 16 are such that reliable closed loop control as described above cannot be carried out. The output impedance of the device 16 becomes significantly larger than the resistance of the feedback resistor 42. In this condition the negative feedback via the resistor 42 becomes dominant and the output of the amplifier 35 settles at the mid-rail desired value with a small amplitude triangular wave ripple introduced by the hysteresis of the voltage comparator.

The ohmic value of the resistor 42 determines the temperature at which the sensing device 16 begins to take over control, the output impedance of the device falling as the temperature rises. The change-over to closed loop control is smooth since the sensor becomes dominant gradually as the temperature rises.

In some circumstances, e.g. when the engine is under full load (throttle wide open but speed relatively low) it is desirable to override the exhaust composition closed loop control and in the example described such overriding is readily obtained by means of a switch 43 connected across the feedback resistor 42. This switch may be a relay contact or an electronic switch having an extremely large off resistance. When the switch 43 is conductive, there is again dominating negative feedback from the amplifier 35 to the amplifier 23 so that the output of the amplifier 35 settles at the mid-rail value.

Figure 3:
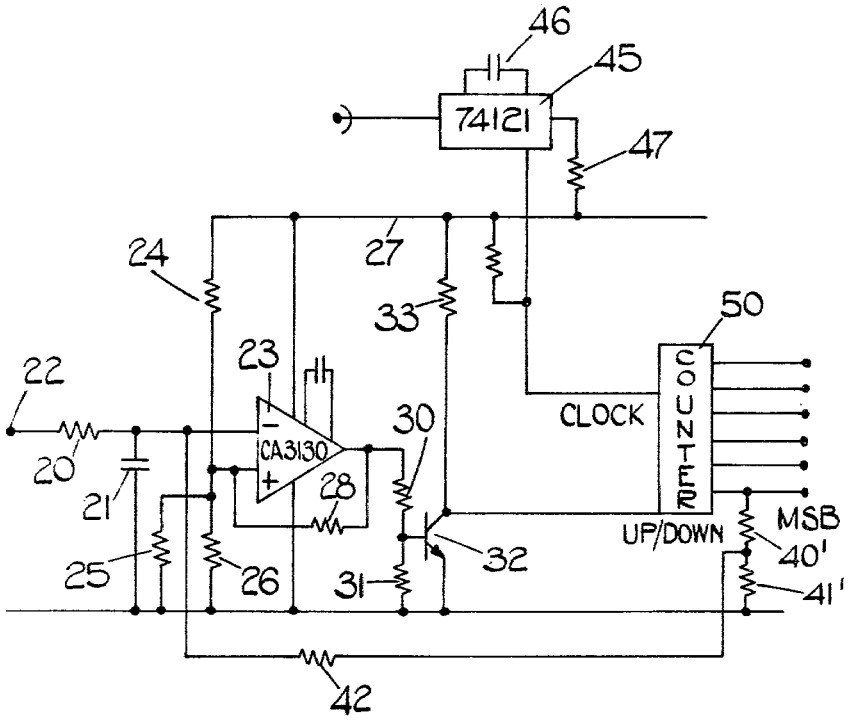
FIG. 3 is the circuit of another example of an exhaust composition control.

In the circuit shown in FIG. 3 the input stage is the same as that shown in FIG. 2 but the integrator stage is constituted by a binary up/down counter 50 which is clocked by the output pulses from the monostable multivibrator 45. The collector of the transistor 32 is connected to the up/down control terminal of the counter 50. The feedback resistor 42 is connected to the common point of two resistors $40^1$, $41^1$ connected in series between the most significant bit output terminal of the counter and earth. These resistors are chosen so that when the MSB output terminal voltage is high the potential at the common point of resistors $40^1$, $41^1$ is sufficiently above 350 mV to switch the comparator from high output to low output when the sensing device 16 is cold.

The clock 14 in this case is controlled by the multibit digital signal from the counter 50.

In the cold condition the counter 50 is clocked repeatedly between 000 . . . 01 and 11 . . . 10 by alternate pulses from the multivibrator 45.

What is claimed is:

1. An internal combustion engine fuel control system comprising an exhaust gas composition sensing device having a high output impedance at low temperature, but producing when at operating temperature, a voltage signal related to the exhaust gas composition and a fuel control circuit to which said sensing device is connected so that variations in the voltage signal therefrom vary the fuel flow to the engine so as to cause the voltage signal to approach a desired level, said fuel control circuit including an input stage connected to the sensor and to a reference voltage source such that the output of said input stage is dependent on the relative levels of the signal voltage and the reference voltage, an integrator stage connected to the output of the input stage and producing an output which changes relatively slowly as a result of changes in the output of the input stage, the output of the integrator stage determining the rate at which fuel is supplied to the engine and a high impedance negative feedback circuit connecting the output of the integrator stage to an input terminal of the input stage and including a high impedance feedback path of impedance less than that of the sensing device at low temperature and higher than that of the sensing device at operating temperature, said feedback circuit causing the output of the integrator to approach a desired value when the sensing device is at low temperature.

2. A control system as claimed in claim 1 in which the input stage is a voltage comparator and the integrator stage is an operational amplifier integrator.

3. A control system as claimed in claim 2 in which the feedback circuit comprises a resistive potential divider connected between the operational amplifier output and an earth terminal and arranged to establish a voltage equal to the reference voltage when the operational amplifier output is at its desired value, said high impedance path being a high impedance resistor connected between said potential divider and an input terminal of the voltage comparator.

4. A control system as claimed in claim 2 or claim 3 further comprising a switch device connected between the comparator output and the integrator input and controlled so as to be conductive periodically at a frequency proportional to engine speed and for a fixed duration at each operation.

5. A control system as claimed in claim 1 further comprising an override switch connected in parallel with said high impedance feedback path.

6. A control system as claimed in claim 1 in which said input stage is constituted by a voltage comparator and said integrator stage is constituted by a multi-bit binary up/down counter, said voltage comparator output being connected to an up/down control terminal of the counter, there being also provided means for producing pulses at a frequency proportional to the engine speed connected to a clock input terminal of the counter.

7. A control system as claimed in claim 6 in which the feedback circuit is connected to a most significant bit output of the counter.

* * * * *